United States Patent [19]

Wiermanski

[11] 4,289,330

[45] Sep. 15, 1981

[54] BOOKBINDING SYSTEM

[75] Inventor: Jerome J. Wiermanski, Wayne, Ill.

[73] Assignee: General Binding Corporation, Northbrook, Ill.

[21] Appl. No.: 83,232

[22] Filed: Oct. 10, 1979

[51] Int. Cl.[3] ..... B42D 1/04

[52] U.S. Cl. ..... 281/21 R; 281/23; 281/29; 11/1 AD

[58] Field of Search ..... 11/1 AD; 281/21 R, 29, 281/23

[56] References Cited

U.S. PATENT DOCUMENTS

| | | | |
|---|---|---|---|
| 3,847,718 | 11/1974 | Watson | 281/29 |
| 3,957,287 | 5/1976 | Hall | 281/29 |
| 3,973,787 | 8/1976 | Staats | 281/21 R |
| 4,141,100 | 2/1979 | Domroe | 281/21 R X |

OTHER PUBLICATIONS

Glaister's Glossary of the Book, (pp. 25, 454).

*Primary Examiner*—Paul A. Bell
*Assistant Examiner*—John S. Brown
*Attorney, Agent, or Firm*—Hill, Van Santen, Steadman, Chiara & Simpson

[57] ABSTRACT

A book cover structure of the type having a spine with front and back cover structures connected to the spine and separated from the spine by scribes to enable the front and back cover structures to flex relative to the spine. A spine strip of hot metal adhesive is secured on an inside face area of the spine. Spacer means for holding sheets in engagement with the spine strip are spaced inwardly of the scribes and comprise a pair of cover strips of hot melt adhesive secured to inside surface areas of the front and back cover structures in spaced adjacency to the scribes with the scribes separating the hot melt adhesive strips on the covers from the strip of hot melt adhesive strip on the spine.

8 Claims, 5 Drawing Figures

FIG. 1
(PRIOR ART)
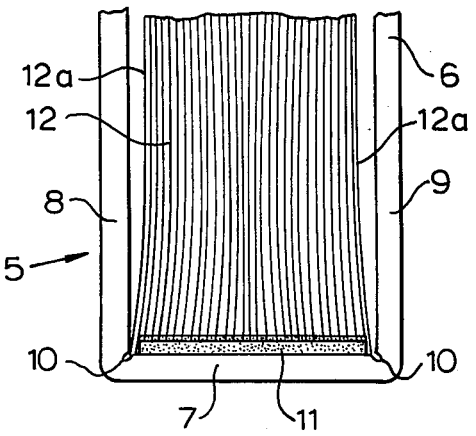
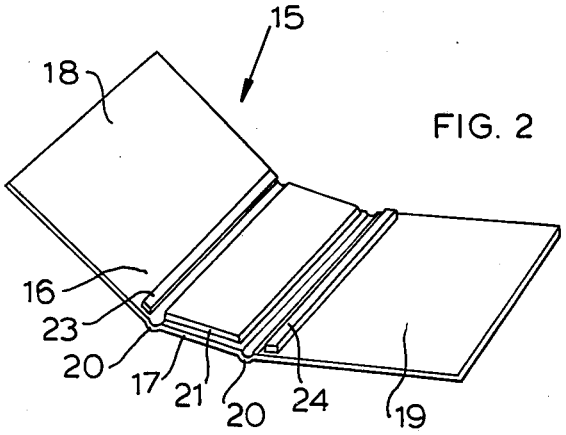
FIG. 2
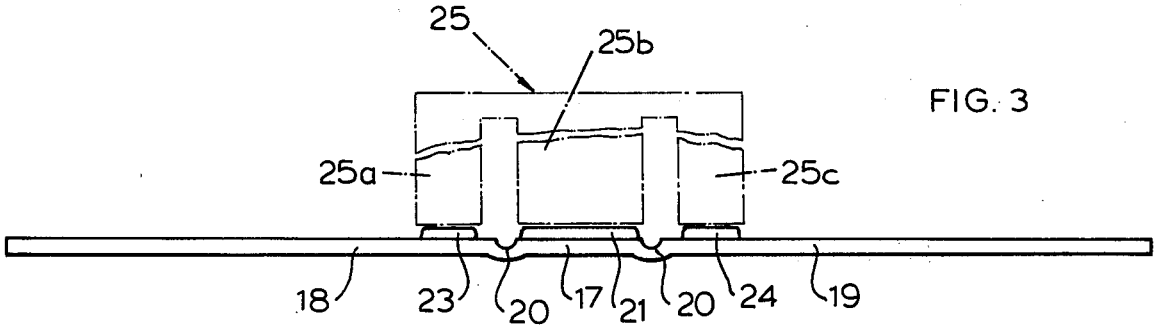
FIG. 3
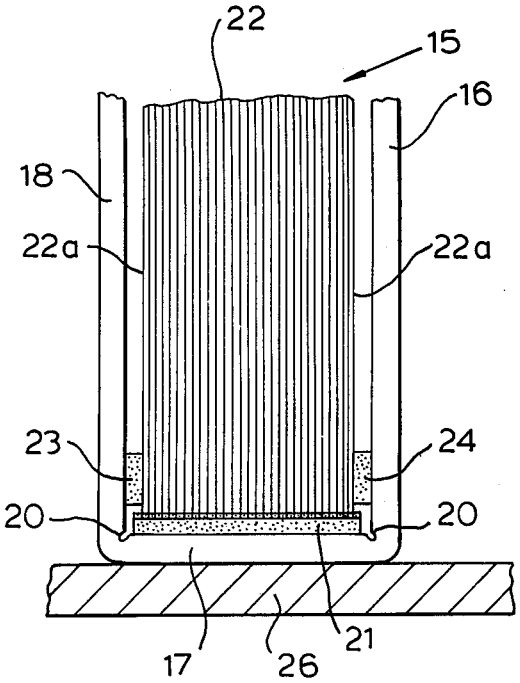
FIG. 4
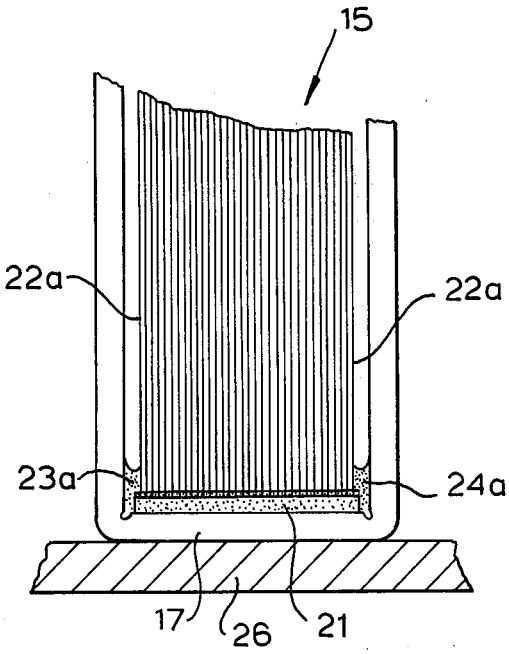
FIG. 5

BOOKBINDING SYSTEM

BACKGROUND OF THE INVENTION

As those familiar with the stationery arts are aware, sheets of paper, or the like, have been bound together at one edge through the medium of resilient adhesive. A well known example of this technique is seen in the typical "pad" of paper in which the individual sheets are sequentially usable, and removable from the pad by physical disengagement from the adhesive. In such binding systems, the sheets have been physically clamped to provide a maximum compression adjacent the edge to be supplied with adhesive. With the clamp sheets thus positioned, an adhesive material has been applied to the exposed edge. Such a system has been similarly applied to pamphlets, books, and the like, utilizing apparatus designed to first stack the sheets in aligned condition and then rigidly clamp the sheets adjacent the edge to be glued. Many books have been bound utilizing such prior art systems. However, for typical office or home use, the apparatus envisaged for such binding procedures has been extremely expensive and has required relatively skilled personnel for its successful operation. In the main, bookbinding done under such circumstances has required large manufacturing facilities and has been done on a high-volume basis only. At the same time, means have continually been sought permitting simple edge-binding. Although simplifications have been attempted in the formely employed clamping systems, continued research led to the development of the bookbinding systems disclosed in U.S. Pat. No. 3,973,787, for use in an ordinary office and home operation. And FIGS. 1–4 and FIGS. 12, 13, and 15 among others show the state of the art prior to the development of the present invention. With the bookbinding system shown in the U.S. Pat. No. 3,973,787 hot melt adhesive spacers of the new type disclosed in this application were not known or previously employed.

SUMMARY OF THE INVENTION

In accordance with the present invention, a thermally activatable adhesive is combined with a loosely gathered sheaf of sheets. The gathered sheets are jogged or otherwise aligned so that the edge thereof to be bound lies horizontally upon a layer of adhesive positioned on a spine between a pair of hot melt adhesive strips provided on inside surface areas of front and back covers of a book cover structure which pair of hot melt adhesive strips provide spacer means for holding the jogged sheets in engagement with the spine strip of hot melt adhesive spaced inwardly of the scribes or scores provided between the front and back covers and the spine of the book cover structure. In this way the cover strips of hot melt adhesive provide spacer means for insuring that the sheets will be held upon the spine strip of hot melt adhesive so as not to fall into the scribes or scores thereby insuring that the outer edges of the sheets can be maintained at a uniform level relative to one another.

By manufacturing the spacer means of a pair of the cover strips of hot melt adhesive manufacturing steps previously required for the placement of release strips 18*a* and 19*a* in U.S. Pat. No. 3,973,787 can be simplified. To this end, a single nozzle with a plurality of outlets can be utilized to simultaneously deposit the strips of hot melt adhesive onto the inside faces of the front and back cover structure simultaneously with the placement of the hot melt adhesive strip onto the spine.

The ultimate user of the bookbinding system herein used can jog the sheets and place them in edgewise relation onto the spine adhesive and a hot plate can be used to heat the strip of spine adhesive causing the edges of the sheets to be bound with the spine. If desired, sufficient heat may also be applied to cause the cover strips of adhesive comprising the spacers to be sufficiently heated so as to bind lower outside faces of the outside sheets with material that is caused to flow from the hot melt adhesive strips on the inside faces of the front and back cover structure.

According to important features of the present invention, a new and improved book cover structure is herein disclosed of the type having spacer means comprising a pair of hot melt adhesive strips positioned on inside front and back cover structure areas for acting either as spacers to hold the sheet spaced from the scribes or scores at the juncture of the front and back cover structures with the spine or to provide means for physically binding outside sheets in assembly with the book cover depending on the manner of bookbinding utilized by the consumer.

Still another object of this invention is to provide a new and improved book cover is provided which can be used for bookbinding in an ordinary office or home operation where front and back covers and a spine joining the covers are all provided with separate strips of hot melt adhesive for assisting in the securement of sheets in assembly with a book cover structure.

DESCRIPTION OF THE INVENTION

FIG. 1 is a fragmentary end view of an adhesive book cover structure manufactured in accordance with the prior art.

FIG. 2 is an isometric view of an adhesive book cover structure in accordance with present invention;

FIG. 3 is a fragmentary end elevation of an adhesive cover structure of the type shown in FIG. 2 illustrating the manner of assembly of adhesive strips onto the cover;

FIG. 4 is an enlarged fragmentary end view showing an adhesive book cover structure in assembly with sheets; and FIG. 5 is an enlarged fragmentary end view with the hot plate in cross-section similiar to FIG. 4 only illustrating the cover strips comprised of hot melt adhesive shown in a melted condition securing outside sheets in place.

DETAILED DESCRIPTION

In FIG. 1 is shown one type of prior art book cover structure such as is illustrated in U.S. Pat. No. 3,973,787. Other types of book cover structures are also shown in this Patent. In this particular embodiment of prior art the book cover structure is indicated by the reference numeral 5 and includes a book cover 6 having a spine 7 and a front cover 8 and a back cover 9 all secured in an assembly together. Scribes 10 separate the front and back cover from the spine and provide flexible areas enabling the front and back covers to flex relative to the spine. A spine strip of hot melt adhesive 11 is secured to the spine and sheets 12 are positioned on top of the strip of adhesive. In the prior art embodiments such as the one illustrated here no means are provided for preventing outside sheets 12*a*—12*a* from accidently falling into the grooves defined by the scribes 10 during the procedure of melting the spine strip of adhesive for securing the sheets in assembly with the spine 7 of the cover 6. It is also here recognized that FIG. 12 of U.S. Pat. No. 3,973,787 among others shows other types of prior art with spacers 18*a*–19*a* for inhibiting the outside sheets such as 12*a*—12*a* from falling into the groove defined by the scribes 10. The present invention concerns itself with a new and improved book cover structure 15 having new and improved spacer means as will now be discussed in further detail hereafter.

The book cover structure 15 includes a book cover 16 having a spine 17 with a front cover 18 and a back cover 19 secured in assembly therewith. Scribes 20 separate the front and back cover 18 and 19 from the spine 17. A strip of hot melt adhesive 21 is secured to the spine 7 in the same manner described in U.S. Pat. No. 3,973,787.

When a consumer is desirous of binding sheets 12 with a book cover 16 the sheets 12 are placed on top of the spine strip of adhesive 21. In the manufacturing of the book cover 16, cover spacer strips 23 and 24 are secured with inside face areas or surface areas of the front and back covers 18 and 19 contemporaneously with the securement of the spine strip of adhesive 21 all as is shown in FIG. 3. To this end a three nozzled header 25 is caused to deposit hot melt adhesive through nozzles 25*a*, 25*b*, and 25*c* as relative movement is caused to occur between the header 25 and the cover 16. Each of the strips 21, 23, and 24 preferably have a thickness of about 0.030" and excellent results can be also secured by varying the thickness to the extent of ±0.005".

The sheets 22 can be bound to the book cover 16 to form a book cover structure 15 by using a hot plate or heater 26 and operating the same in the same manner disclosed in U.S. Pat. No. 3,973,787 with particular reference to the discription provided in columns 5 and 6 of this patent.

An examination of adhesive materials that are satisfactory for the present method shows that a large number of so-called "hot-melt" adhesive having in the range of 20–40 percent of ethylene vinyl acetate of a medium to high viscosity in combination with about 20% tackifier, ordinarily a natural rosin, with the balance of microcrystalline wax as a carrier with a melt point on the order of 150°–160° F. may be used. It is desirable that the melt temperature of the adhesive composite approximate 220° F., and that the adhesive be remeltable so that additional pages may be added later, if desired.

A typical cover may, as above noted, comprise a paper card, or similar stock. Preferably, the spine 17 is then spread with a layer of the thermally activated or hot-melt adhesive. We have found that in spite of the fact that linear polyethylene material, sometimes used in book binders, has poor adhesion to conventional glues, it very satisfactorily sticks to the hot melt adhesive above described and provides a practically indestructable cover far superior to any heretofore employed. Further, we have found that the application of such a cover, with its adhesive, to a heater at a temperature on the order of 325° F. for the relatively short period of time described above, does not in any way adversely affect the cover or its contents.

The heater or plate 26 that is used to melt the adhesive strip 21 can be of any suitable type. As an example, the hot plate or heater 26 can be operated in the same way as the heater 20 described in U.S. Pat. No. 3,973,787.

Where it is desired to actually cause the cover strips 23 and 24 of hot melt adhesive to melt and adhere to outside sheets 22*a*, 22*a* the hot plate 26 can be cycled through a second period of operation so that additional heat is caused to be applied to the adhesive strips 23–24 to cause them to melt as illustrated at 23*a* and 24*a* in FIG. 5. In this way, the cover strips 23, 24, when melted, become merged with the hot melt adhesive strip at 21 on the spine 17. In this respect it will be appreciated that the customer that ultimately buys the machine for heating the adhesive as generally indicated at 26 must make the decision of whether to cause the bookbinding operation to be conducted in such a way as to utilize the strips 23 and 24 merely as spacers in the bookbinding operation or whether to cause the strips 23 and 24 to be melted and bonded with the spine strip of adhesive 21 as indicated at 23*a* and 24*a* in FIG. 4.

Any suitable material may be used for the manufacture of the bindings or book covers 16 and preferred materials are discussed in the prior art and in this connection attention is directed to column 6 of the aforesaid Patent. Also, with respect to the pages or sheets 22, these sheets may be made from any suitable material such as is described in column 6 and 7 of the U.S. Pat. No. 3,973,787.

I claim as my invention:

1. A book cover structure of the type having a spine with front and back covers connected to the spine and separated from the spine by scribes to enable the front and back covers to flex relative to the spine, the improvement comprising a spine strip of hot melt adhesive being secured on an inside face area of said spine, and spacer means for holding sheets in engagement with said spine strip spaced outwardly of said scribes comprising a pair of cover strips of hot melt adhesive secured to inside surface areas of the front and back covers in spaced adjacency to the scribes with the scribes separating the hot melt adhesive strips on the covers from the strip of hot melt adhesive on the spine.

2. The book cover structure of claim 1 further characterized by a series of sheets being mounted in edgewise relationship upon said spine strip of hot melt adhesive inwardly of said scribes and with said spine strip of hot melt adhesive (providing a bond after being heated) being in a bonded state and physically joining lower edges of the sheets with the spine of the bookcover to thereby constitute a book.

3. The book cover structure of claim 2 further characterized by the spaced strips of hot melt adhesive being free of (serving strictly as spacers and not providing any bonded area between said strips and) opposed surface areas of outside ones of said sheets bonded with said strip of hot melt adhesive provided on the spine.

4. The book cover structure of claim 2 further characterized by said cover strips of hot melt adhesive being bonded and thereby connected with opposed surface areas of outside ones of said sheets of the areas of said scribes thus providing further securement for the sheets secured with said spine to thereby constitute a book.

5. The book cover structure of claim 1 further characterized by the cover strips of hot melt adhesive having a thickness on the order of 0.030".

6. The book cover structure of claim 2 further characterized by the cover strips of hot melt adhesive having a thickness on the order of 0.030".

7. The book cover structure of claim 5 further characterized by the backbone strip of adhesive having a thickness on the order of 0.030".

8. A method for book binding including a book cover structure of the type having a spine with front and back covers connected to the spine and separated from the spine by scribes to enable the front and back covers to flex relative to the spine, the steps of securing a spine strip of hot melt adhesive on an inside face area of said spine, and securing a pair of cover strips of hot melt adhesive to inside surface areas of the front and back covers in spaced adjacency to the scribes with the scribes separating the hot melt adhesive strips on the covers from the strip of hot melt adhesive strip on the spine, and placing a series of sheets in edge-wise relationship upon said spine strip of hot melt adhesive inwardly of said scribes and with said spine strip of hot melt adhesive being heated to produce a bond joining lower edges of the sheets with the spine of the book cover, said cover strips of hot melt adhesive being bonded with opposed surface areas of outside ones of said sheets at the areas of said scribes thus providing further securement for the sheets secured with said spine.

* * * * *